US010145640B2

(12) United States Patent
Rassulov

(10) Patent No.: US 10,145,640 B2
(45) Date of Patent: Dec. 4, 2018

(54) CROSSBOW

(71) Applicant: Aleksei Mossudovich Rassulov, Perm (RU)

(72) Inventor: Aleksei Mossudovich Rassulov, Perm (RU)

( * ) Notice: Subject to any disclaimer, the term of this patent is extended or adjusted under 35 U.S.C. 154(b) by 0 days.

(21) Appl. No.: 15/564,958

(22) PCT Filed: Dec. 28, 2016

(86) PCT No.: PCT/RU2016/000942
§ 371 (c)(1),
(2) Date: Oct. 6, 2017

(87) PCT Pub. No.: WO2017/116288
PCT Pub. Date: Jul. 6, 2017

(65) Prior Publication Data

US 2018/0209759 A1 Jul. 26, 2018

(30) Foreign Application Priority Data

Dec. 31, 2015 (RU) ..... 2015157452

(51) Int. Cl.
*F41B 5/12* (2006.01)

(52) U.S. Cl.
CPC ..... *F41B 5/12* (2013.01)

(58) Field of Classification Search
CPC ..... F41B 5/12; F41B 5/123
See application file for complete search history.

(56) References Cited

U.S. PATENT DOCUMENTS 5,971,875 A * 10/1999 Hill ..... F42B 6/06 473/578
6,203,457 B1 * 3/2001 Snook ..... F42B 6/06 473/586
6,478,700 B2 * 11/2002 Hartman ..... F42B 6/04 124/91

(Continued)

*Primary Examiner* — John Ricci
(74) *Attorney, Agent, or Firm* — Aleksandr Smushkovich

(57) ABSTRACT

The invention relates to the field of sports weapons. The crossbow comprises a bow with a bow string, a shoulder stock and a tubular stock which connects said bow and shoulder stock and has two diametrically arranged longitudinal helical grooves, the helical grooves in the stock are of through design, and the bow string is passed through the helical grooves, wherein the helical grooves have a length of not less than the value of the bow string tensioning motion. Furthermore, an arrow to be launched is arranged inside the stock and is brought into engagement with the bow string such that an axial force and a rotational moment can be transmitted to one of the structural elements: by means of an annular slide with two radial openings which are open therein, are diametrically arranged and through which the bow string is passed, inside a tube inserted into said openings, or without a slide, only with the aid of a tube which is slipped onto the bow string, for which supports are formed on the bow string, or directly from the bow string, without a slide and without a tube. A simplification of the design, a reduction in the weight and necessary power of the crossbow, and an increase in the stabilization of an arrow during flight are achieved.

9 Claims, 9 Drawing Sheets

(56) References Cited

U.S. PATENT DOCUMENTS

| | | | | |
|---|---|---|---|---|
| 6,595,880 | B2 * | 7/2003 | Becker | F42B 6/04 124/44.5 |
| 9,022,013 | B2 * | 5/2015 | Trpkovski | F41B 5/10 124/25 |
| RE46,213 | E * | 11/2016 | Hajari | F42B 6/06 |
| 2016/0290757 | A1 * | 10/2016 | Khoshnood | F41B 5/123 |

* cited by examiner

Turned A-A Section

Turned B-B Section

CROSSBOW

CROSS-REFERENCE TO RELATED APPLICATIONS

This application is a U.S. national stage application of an international application PCT/RU2016/000942 filed on 28 Dec. 2016, published as WO/2017/116288, which international application claims priority of a Russian Federation patent application RU 2015157452 filed on 31 Dec. 2015.

FIELD OF THE INVENTION

The invention relates to the field of sports weapons and can be used for the creation of crossbows with increased power and accuracy providing minimum weight and design simplicity.

BACKGROUND OF THE INVENTION

There are known patents of the Russian Federation No 22059188 of 27 Apr. 1999, No 22150651 of 10 Jun. 2000, No 22239760 of 10 Nov. 2004, which provide torsion of the launched projectile (an arrow or a bullet) around the longitudinal axis for stabilization of an arrow during the flight. However, each of the said crossbows has an intricate and heavy moving unit dedicated for the spinning of an arrow or a bullet, hence requires increased demanded bow force, its weight and the weight of the crossbow on the whole.

Also there is known a sport crossbow patent of the Russian Federation No 22308655 of 20 Oct. 2007 (herein below called 'prototype'), which comprises a bow, a shoulder stock, a trigger, a stock and a slide, an arrow of which is made hollow; the stock is made in the shape of a tube, outside diameter of which is smaller than an inside diameter of an arrow, a slide is made in the shape of a ring with its inside diameter bigger than an outside diameter of the stock and smaller than an outside diameter of an arrow, moreover there is a groove on the slide for the bow string, and the bow string in its central part is split. This crossbow can contain two diametrically opposed helical grooves on the external surface of the tube-stock and at the same time on the internal surface of the arrow tailpiece there are two diametrically opposed pins responding to the grooves.

The disadvantages of this crossbow are first of all comparatively large radial dimensions of an arrow which encloses a tubular stock and its enlarged length, required for interaction with annular slide and enabling sufficient duration of pins contact at the tailpiece of the arrow with the helical grooves of the stock. For the acceleration of such an arrow with enlarged dimensions and in order to overcome friction forces created by its rotation related to the slide and stock it is required corresponding effort of bow string tensioning, ensured by provision of required rigidity (thickness of limbs) of the bow, therefore its increased dimensions and weight and consequently of the crossbow on the whole. Second of all, the necessity to make a split bow string complicates the design of the crossbow.

OBJECT AND BRIEF SUMMARY OF THE INVENTION

The target of this invention is a crossbow weight reduction and design simplification. This is ensured by the fact that, in contrast with the known engineering solution, there are diametrically arranged radial openings in the slide and helical grooves in the stock are of through design, the bow string is passed through these openings and helical grooves, wherein the helical grooves have a length of not less than the value bow string tensioning motion and an arrow is placed inside the stock and is brought into engagement with the bow string with the possibility of transmission of axial force and rotational moment.

The bow string can be inserted into radial openings of the slide and helical grooves of the stock by means of a tube which is slipped onto the bow string, and the arrow is engaged with the tube. Also, the bow string can be inserted through the grooves of the stock without a slide and only with a tube provided that there are supports made for the tube on the bow string. The stock can be connected with the shoulder stock and the bow in such a way that when the projection of the loose bow string on a plane that is perpendicular to the longitudinal axis is linear, then the projection of the tense bow string on the same plane is S-shaped and vice versa when the projection of the loose bow string on a plane that is perpendicular to the longitudinal axis is S-shaped, the projection on the same plane of the tensed bow string is linear.

The radial openings of the slide and grooves of the stock which are of though design allow the bow string to be passed through the stock and that transmits the force of the bow string tension to an arrow placed inside the stock by means of the slide and the tube or just the tube. The possibility of placement of the arrow inside the stock decreases the dimensions and weight of an arrow and thus the demanded force of the bow string tensioning which also means a decrease of the rigidity, dimensions, bow and crossbow weight on the whole. Bow string tensioning (pulling-off) by helical grooves provides elimination of mutual friction of the slide and rotating arrow as it happens in the prototype, that also decreases demanded force of the bow deformation which increases its weight and the weight of the crossbow on the whole.

The crossbow design also is simplified by the fact that, first of all, the stock is a structural element which connects parts of the crossbow—the bow and the shoulder stock—into a single whole. And second of all, the stock is a guideway for the axial and rotating movements of the arrow during acceleration. The helical grooves of through design on the sides of the stock allow application of the simple one-piece bow string passed crosswise the stock that also contributes to the simplification of the crossbow design in comparison with the prototype.

DESCRIPTION OF DRAWINGS OF THE INVENTION

DETAIL DESCRIPTION OF PREFERRED EMBODIMENTS OF THE INVENTION

Figure 1:
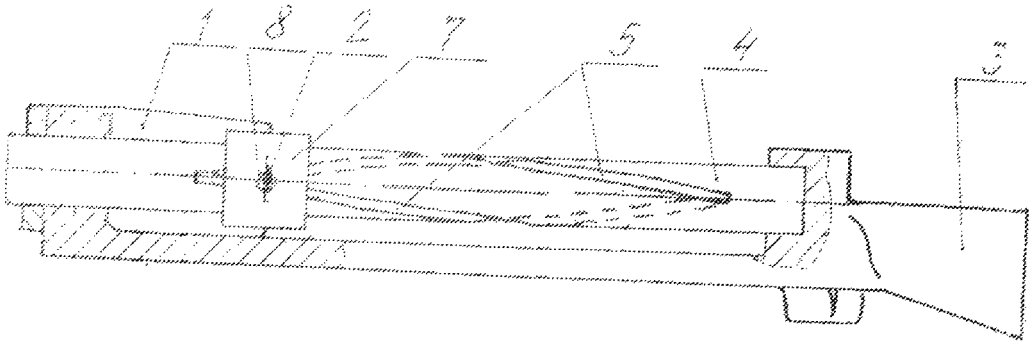
FIG. 1 shows a front view of a crossbow with "loose bow string", containing a slide and a tube, with the stock fixated against the bow in such a way that gives linear projection of the loose bow string on a plane that is perpendicular to the longitudinal axis of the stock, and the S-shaped projection of the tensed bow string on the same plane.
Figure 2:
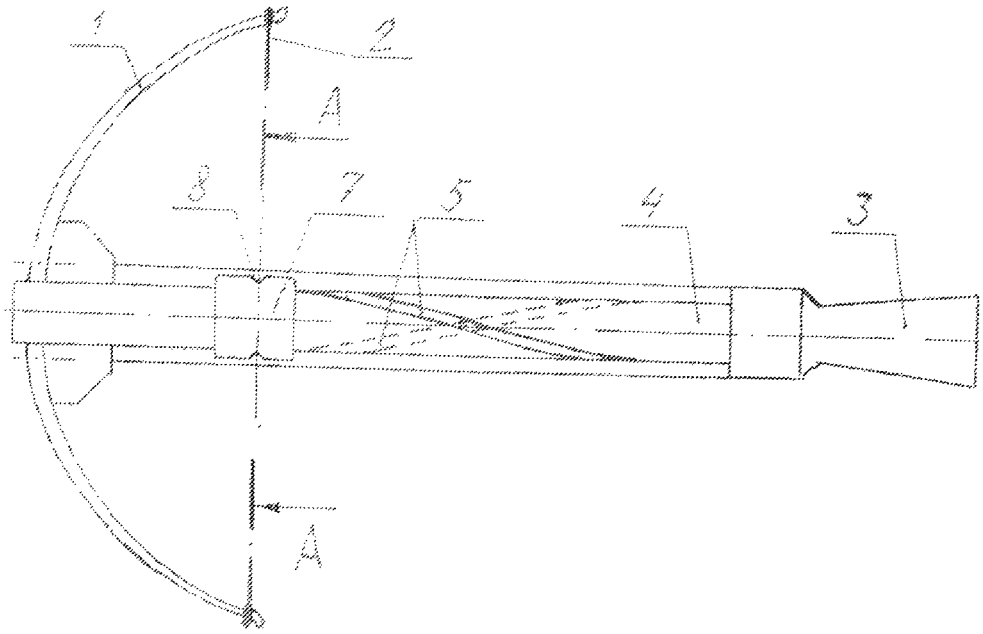
FIG. 2 shows a top view of a crossbow with a "loose bow string", containing a slide and a tube, with the stock fixated against the bow in such a way that gives linear projection of the loose bow string on a plane that is perpendicular to the longitudinal axis of the stock, and the S-shaped projection of the tensed bow string on the same plane.

The crossbow contains a bow 1 with the bow string 2, a shoulder stock 3, a tubular stock 4 with longitudinal helical grooves of through design 5, an arrow 6, an annular slide 7.

Figure 3:
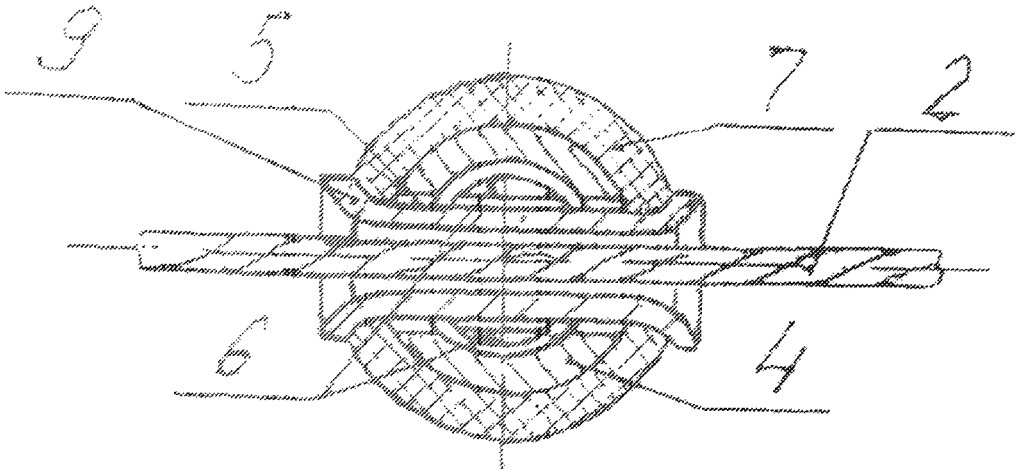
FIG. 3 shows A-A section of the crossbow represented on FIG. 2, illustrating relative arrangement of the slide, tube and bow string.
Figure 6:
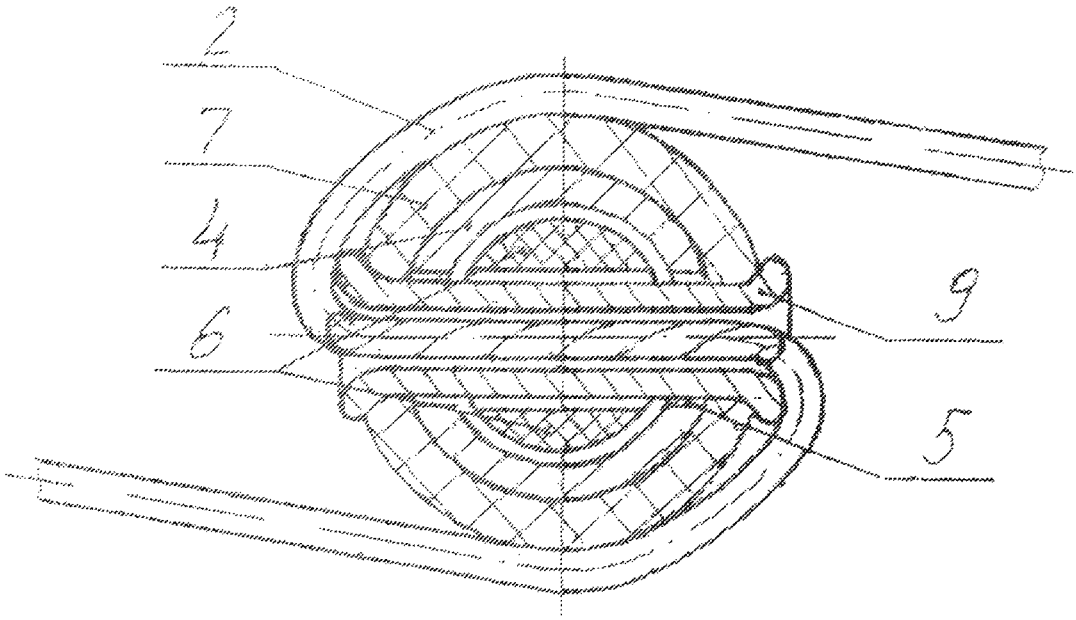
FIG. 6 shows B-B section of the crossbow represented on FIG. 5, illustrating relative arrangement of the slide, tube and tensed bow string.
Figure 7:
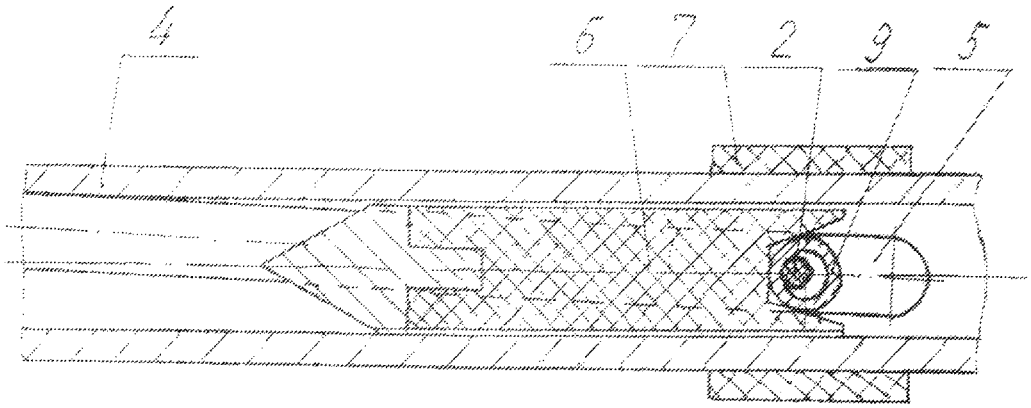
FIG. 7 shows vertical longitudinal section of the stock in the area of crossbow arrow placement containing annular slide and tube, with a "tensed bow string" in such a way that gives S-shaped projection of the loose bow string on a plane that is perpendicular to the longitudinal axis of the stock, and the linear projection of the tensed bow string on the same plane.
Figure 8:
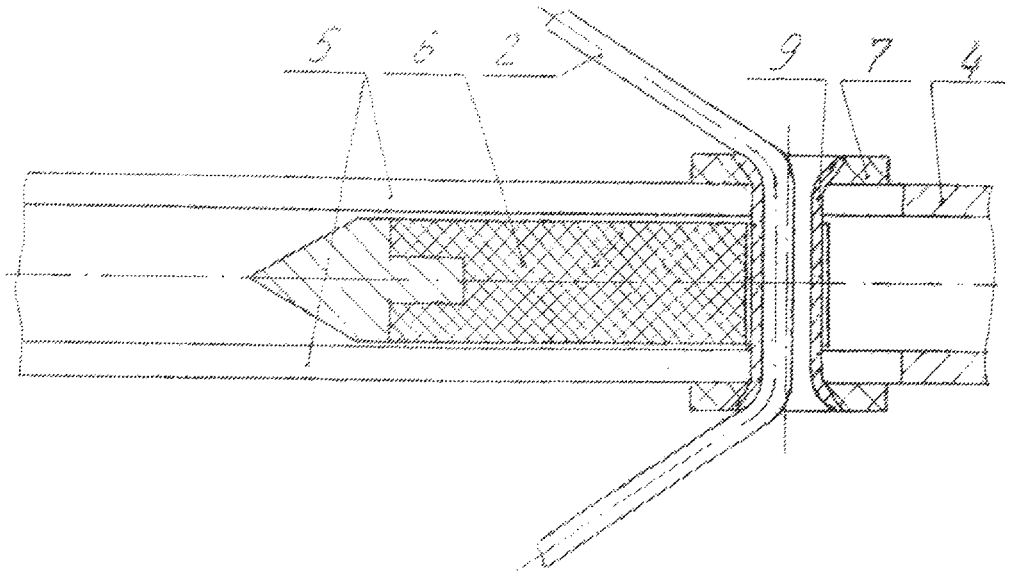
FIG. 8 shows horizontal longitudinal section of the stock in the area of crossbow arrow placement containing annular slide and tube, with a "tensed bow string" in such a way that gives S-shaped projection of the loose bow string on a plane that is perpendicular to the longitudinal axis of the stock, and the linear projection of the tensed bow string on the same plane.

In the annular slide 7 there are made radial openings 8 with inserted wearproof tube 9, that simultaneously goes through helical grooves 5 on the stock 4. The bow string 2 goes through the tube 9 and consequently crosswise the stock 4. The stock 4 is connected to the bow 1 and shoulder stock 3 by its nonsplit ends. In one of the crossbow design options the stock 4 is connected with the shoulder stock 3 and the bow 1 in such a way that the projection of the loose bow string 2 on the plane perpendicular to the longitudinal axis of the stock 4 is linear (FIG. 3), and the projection of the tensed bow string 2 on the same plane is S-shaped (FIG. 6).

Another possible option of crossbow design is a version where the stock 4 is connected to the shoulder stock 3 and the bow 1 in such a way that the projection of the loose bow string 2 on the plane perpendicular to the longitudinal axis of the stock 4 is S-shaped and the projection of the tensed bow string on the same plane is linear (FIG. 7-12).

Figure 9:
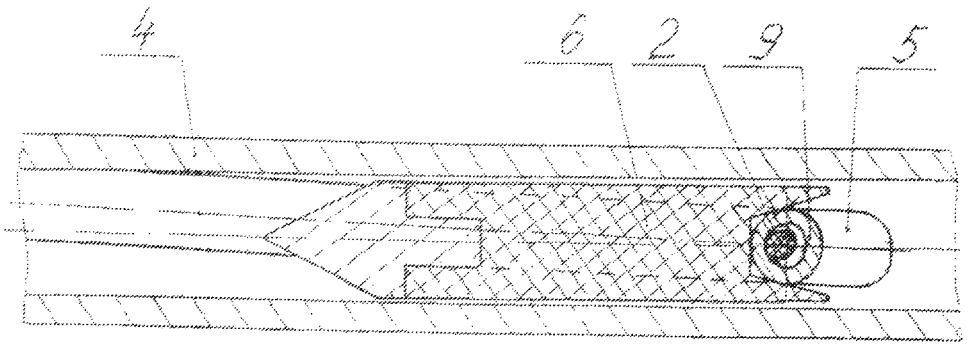
FIG. 9 shows vertical longitudinal section of the stock in the area of crossbow arrow placement containing a tube, with a "tensed bow string" in such a way that gives S-shaped projection of the loose bow string on a plane that is perpendicular to the longitudinal axis of the stock, and the linear projection of the tensed bow string on the same plane.
Figure 10:
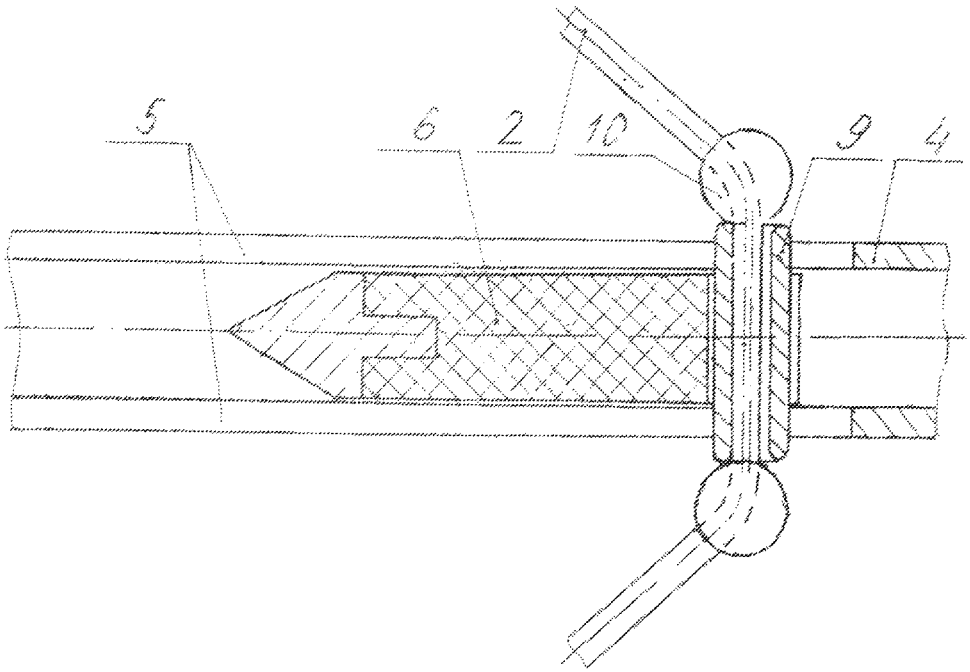
FIG. 10 shows horizontal longitudinal section of the stock in the area of crossbow arrow placement containing a tube, with a tensed bow string in such a way that gives S-shaped projection of the loose bow string on a plane that is perpendicular to the longitudinal axis of the stock, and the linear projection of the tensed bow string on the same plane.
Figure 11:
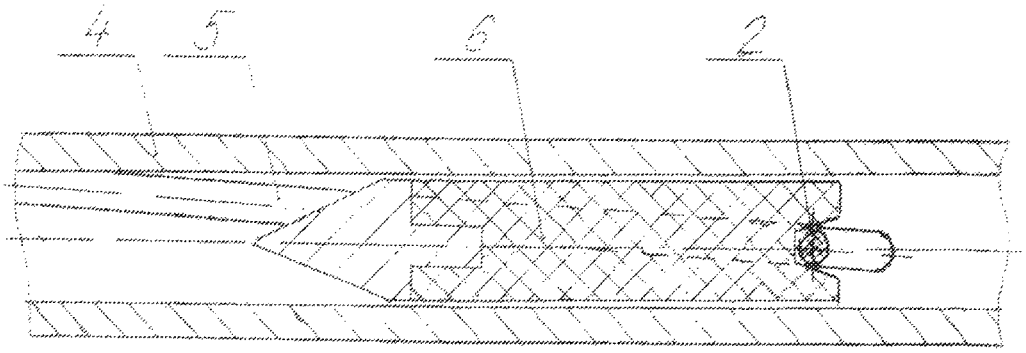
FIG. 11 shows vertical longitudinal section of the stock in the area of crossbow arrow placement which does not contain an annular slide or a tube, with a tensed bow string in such a way that gives S-shaped projection of the loose bow string on a plane that is perpendicular to the longitudinal axis of the stock, and the linear projection of the tensed bow string on the same plane.
Figure 12:
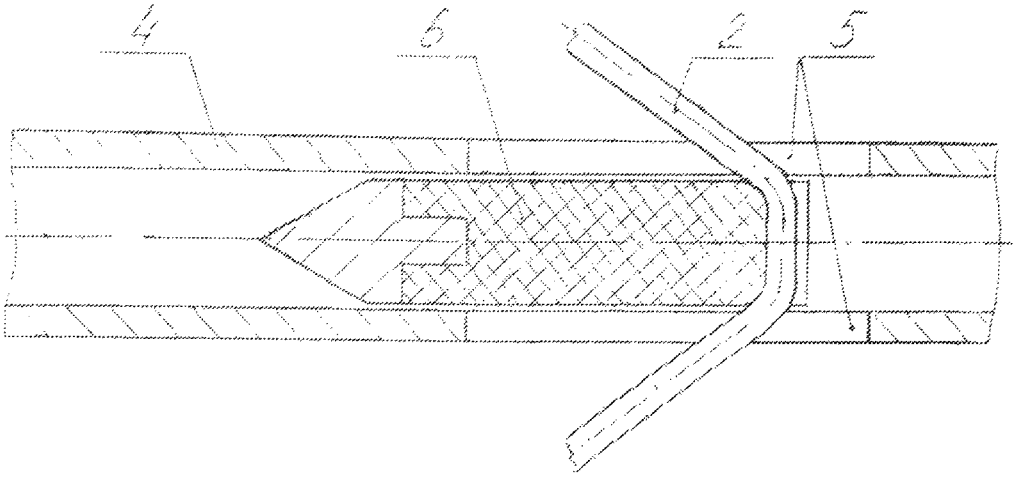
FIG. 12 shows horizontal longitudinal section of the stock in the area of crossbow arrow placement which does not contain an annular slide or a tube, with the tensed bow string in such a way that gives S-shaped projection of the loose bow string on a plane that is perpendicular to the longitudinal axis of the stock, and the linear projection of the tensed bow string on the same plane.

In both above mentioned design options of stock 4 connection with the shoulder stock 3 and the bow 1 the arrow 6 in the crossbow with tensed bow string is placed inside the stock 4 (FIG. 7, 8) and is slipped on the tube 9 by its groove in the rear part, that provides the possibility of transmission to the arrow 6 of the axial force and the rotational moment from the bow string 2. There is a feasible design option of the given crossbow when the bow string 2 is passed through the grooves 5 of the stock 4 only by means of the tube 9 and without the slide 7 (FIG. 9, 10). In this case, there are formed the supports 10 on the bow string 2, e.g. as a fiber winded crosswise on the bow string 2. The bow string 2 can also be passed through the grooves 5 without a slide 7 and without a tube 9 as shown in FIGS. 11, 12. In this case the bow string 2 is to be made of wearproof material.

The crossbow design option when the projection of the loose bow string 2 on the plane perpendicular to the longitudinal axis of the stock 4 is linear and the projection of the tensed bow string 2 on the same plane is S-shaped operates in the following way.

Figure 4:
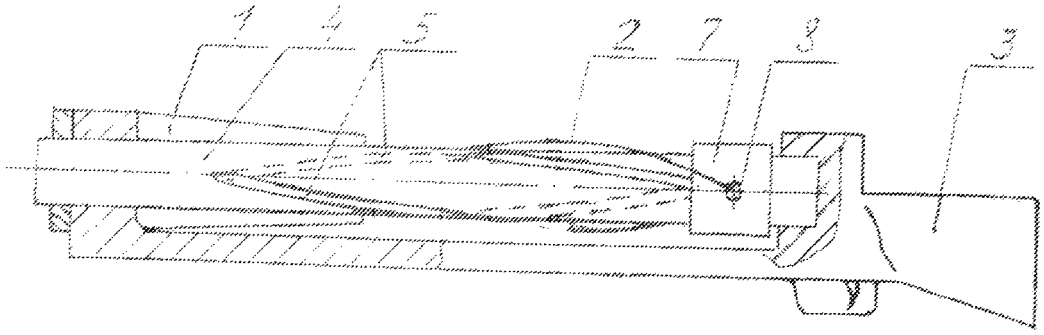
FIG. 4 shows a front view of a crossbow with a "tensed bow string", containing a slide and a tube, with the stock fixation against the bow in such a way that gives linear projection of the loose bow string on a plane that is perpendicular to the longitudinal axis of the stock, and the S-shaped projection of the tensed bow string on the same plane.
Figure 5:
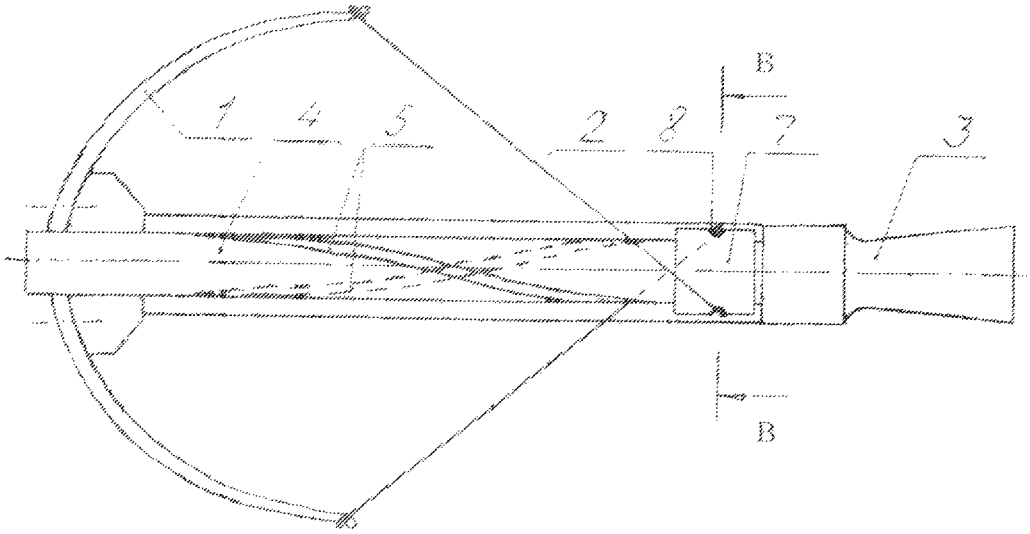
FIG. 5 shows a top view of a crossbow a "tensed bow string", containing a slide and a tube, with the stock fixation against the bow in such a way that gives linear projection of the loose bow string on a plane that is perpendicular to the longitudinal axis of the stock, and the S-shaped projection of the tensed bow string on the same plane.

When the trigger of the crossbow with the tensed bow string (FIG. 4, 5) is pulled, according to the applied design option, from the stock 4 disconnects the annular slide 7 with a tube 9 and the bow string 2, or just the tube 9 with the bow string 2, or just the bow string 2 and they start to move along the stock 4 forced by the axial force of the tensed bow string 2 pushing an arrow 6 forward. Simultaneously it is performed a rotation with arrow 6 acceleration, which is engaged with annular slide 7, tube 9, bow string 2 rotating and gliding though helical grooves 5 as is shown in one of the abovementioned options.

At the moment of full straightening of the bow 1, the bow string 2 together with connected elements—annular slide 7 and tube 9 or tube 9—stops and the arrow 6 by means of the chamfered groove in its rear part disconnects from them and continue its inertial motion up to its shooting from the stock 4.

The invention claimed is:

1. A crossbow comprising:

a bow (1);

a bow string (2) characterized at least with a tensed position corresponding to a predetermined displacement of a central portion of said bow string (2);

a shoulder stock (3);

a tubular stock (4) coupled with said bow (1), said bow string (2), and said shoulder stock (3); wherein said tubular stock (4) defines a longitudinal axis and walls; said tubular stock (4) includes two diametrically opposed longitudinal helical grooves (5) cut through the walls; wherein said helical grooves (5) have a length being at least equal to or exceeding the predetermined displacement;

an arrow (6) arranged inside the tubular stock (4); said arrow (6) is brought into engagement with the bow string (2);

an annular slide (7) having two radial openings (8) arranged therein diametrically opposed to each other; and a tubular part (9) inserted into said openings (8), whereas the bow string (2) is passed inside said tubular part (9) that passes through the helical grooves (5);

wherein an axial force and a rotational moment caused by the bow string (2) being in the tensed position relative to the longitudinal axis are transmitted to the arrow (6) by means of said annular slide (7) and said tubular part (9).

2. The crossbow according to claim 1, wherein:

the bow string (2) is further characterized with a loose position;

and wherein:

the tubular stock (4) is coupled with the shoulder stock (3) and the bow (1) in such a way that a projection of the bow string (2) being in the loose position on a plane perpendicular to the longitudinal axis is a straight line, and a projection of the bow string (2) being in the tensed position on said plane is an S-shaped line.

3. The crossbow according to claim 1 wherein:

the bow string (2) is further characterized with a loose position;

and wherein:

the tubular stock (4) is coupled with the shoulder stock (3) and the bow (1) in such a way that a projection of the bow string (2) being in the loose position on a plane perpendicular to the longitudinal axis is an S-shaped line, and a projection of the bow string (2) being in the tensed position on said plane is a straight line.

4. A crossbow comprising:

a bow (1);

a bow string (2) characterized at least with a tensed position corresponding to a predetermined displacement of a central portion of said bow string (2);

a shoulder stock (3);

a tubular stock (4) coupled with said bow (1), said bow string (2), and said shoulder stock (3); wherein said tubular stock (4) defines a longitudinal axis and walls, said tubular stock (4) includes two diametrically opposed longitudinal helical grooves (5) cut through the walls; wherein said helical grooves (5) have a length being at least equal to or exceeding the predetermined displacement;

an arrow (6) arranged inside the tubular stock (4); said arrow (6) is brought into engagement with the bow string (2);

a tubular part (9) slipped onto the bow string (2), with the aid of supports formed of said bow string (2);

wherein an axial force and a rotational moment caused by the bow string (2) being in the tensed position relative to the longitudinal axis are transmitted to the arrow (6) by means of said tubular part (9).

5. The crossbow according to claim 4, wherein:

the bow string (2) is further characterized with a loose position; and wherein:

the tubular stock (4) is coupled with the shoulder stock (3) and the bow (1) in such a way that a projection of the bow string (2) being in the loose position on a plane perpendicular to the longitudinal axis is a straight line, and a projection of the bow string (2) being in the tensed position on said plane is an S-shaped line.

6. The crossbow according to claim 4, wherein:

the bow string (2) is further characterized with a loose position; and wherein:

the tubular stock (4) is coupled with the shoulder stock (3) and the bow (1) in such a way that a projection of the bow string (2) being in the loose position on a plane perpendicular to the longitudinal axis is an S-shaped line, and a projection of the bow string (2) being in the tensed position on said plane is a straight line.

7. A crossbow comprising:

a bow (1);

a bow string (2) characterized at least with a tensed position corresponding to a predetermined displacement of a central portion of said bow string (2);

a shoulder stock (3);

a tubular stock (4) coupled with said bow (1), said bow string (2), and said shoulder stock (3); wherein said tubular stock (4) defines a longitudinal axis and walls, said tubular stock (4) includes two diametrically opposed longitudinal helical grooves (5) cut through the walls; wherein said helical grooves (5) have a length being at least equal to or exceeding the predetermined displacement;

an arrow (6) arranged inside the tubular stock (4); said arrow (6) is brought into engagement with the bow string (2);

wherein an axial force and a rotational moment caused by the bow string (2) being in the tensed position are directly transmitted to the arrow (6).

8. The crossbow according to claim 7, wherein:

the bow string (2) is further characterized with a loose position; and wherein:

the tubular stock (4) is coupled with the shoulder stock (3) and the bow (1) in such a way that a projection of the bow string (2) being in the loose position on a plane perpendicular to the longitudinal axis is a straight line, and a projection of the bow string (2) being in the tensed position on said plane is an S-shaped line.

9. The crossbow according to claim 7, wherein:

the bow string (2) is further characterized with a loose position; and wherein:

the tubular stock (4) is coupled with the shoulder stock (3) and the bow (1) in such a way that a projection of the bow string (2) being in the loose position on a plane perpendicular to the longitudinal axis is an S-shaped line, and a projection of the bow string (2) being in the tensed position on said plane is a straight line.

* * * * *